US006644984B2

(12) United States Patent
Vista, Jr. et al.

(10) Patent No.: US 6,644,984 B2
(45) Date of Patent: Nov. 11, 2003

(54) PLUG ASSEMBLY WITH SPRING LOADED CONTACT TERMINALS

(75) Inventors: Fidel P. Vista, Jr., Las Pinas (PH); Jose A. Uy, Jr., Quezon (PH); Anthony Hernandez, Quezon (PH); Cesar Ma. C. Calma, Quezon (PH)

(73) Assignee: Astec International Limited, Hong Kong (HK)

( * ) Notice: Subject to any disclaimer, the term of this patent is extended or adjusted under 35 U.S.C. 154(b) by 0 days.

(21) Appl. No.: 10/071,342

(22) Filed: Feb. 8, 2002

(65) Prior Publication Data

US 2003/0153200 A1 Aug. 14, 2003

(51) Int. Cl.[7] ..... H01R 12/00
(52) U.S. Cl. ..... 439/76.1
(58) Field of Search ..... 439/76.1, 78–84, 439/131, 171–175, 518; 320/111; 363/146

(56) References Cited

U.S. PATENT DOCUMENTS 4,941,830 A * 7/1990 Tkazyik et al. ..... 439/59
5,160,879 A * 11/1992 Tortola et al. ..... 320/2
5,494,449 A * 2/1996 Chioo ..... 439/76.1
5,540,596 A * 7/1996 Bothe et al. ..... 439/76.1
5,628,641 A 5/1997 Hahn
D381,314 S 7/1997 Hahn
D427,965 S 7/2000 Wu
6,109,977 A 8/2000 Baxter et al.

* cited by examiner

*Primary Examiner*—Ross Gushi
(74) *Attorney, Agent, or Firm*—Coudert Brothers LLP

(57) ABSTRACT

A plug assembly having a body portion, a plug housing that provides a mounting for AC prongs that creates a cavity therewithin, and a PCB located in the cavity. A pair of contact terminals are mounted on the PCB in a predetermined position so as to create a spring-loaded electrical contact with a corresponding one of the AC prongs during assembly. The present invention reduces the bulkiness, optimizes the packaging size, and reduces the profile of the plug assembly by using the cavity to house the PCB, thereby providing a reduction or elimination of the need to mount components within the body portion. The present invention eliminates the need to use flexible wires, springs, or direct soldering between the AC prongs and the circuitry on the PCB, thereby making assembly quicker and easier through use of the spring loaded contact terminal.

9 Claims, 12 Drawing Sheets

PLUG ASSEMBLY WITH SPRING LOADED CONTACT TERMINALS

FIELD OF INVENTION

The present invention relates to electrical plug assemblies, and more particularly to an electrical plug assembly having a plug housing including a printed circuit board mounted therein, and spring-loaded contact terminals mounted on the printed circuit board to provide an electrical connection between the prongs of the plug housing and the circuit on the printed circuit board.

BACKGROUND OF THE INVENTION

Modern portable electronic devices, such as cellular phones, typically are powered by a DC power source, usually delivered by rechargeable batteries installed in the device. Plug assemblies, such as plug chargers, are typically used to couple these portable electronic devices to an AC power source in order to provide the required voltages to recharge the batteries. Various non-portable electrical devices typically are powered only from an AC power source, usually delivered through a plug connected to a wall receptacle or socket, but require that this AC power be converted into the required DC voltages for powering these devices. Electrical plug assemblies, such as plug adapters, are often used to convert the AC power to provide the required DC voltages to these electrical devices. The modern technology trend is towards higher density and lower profile electrical devices. A common disadvantage of known plug assemblies is that these assemblies are bulky and inefficient in the use of available space. There is thus a need to optimize the packaging size of plug assemblies used with electrical devices.

Plug assemblies typically include a body portion and a plug housing having an electrical plug for enabling the plug assembly to be connected to an AC power source through a wall receptacle or socket. Electrical plugs throughout the world include various configurations of AC prongs or pins (hereinafter referred to as prongs) that extend outwardly from the plug housing and are shaped to enable electrical and mechanical connection to the AC wall receptacle or socket. Various plug housings provide a mounting for the AC prongs which creates a hollow portion or cavity within the plug housing. The European plug standards CEE 7/16 and EN50075, for example, specify the use of an extended plastic base to house a portion of the AC prongs, thereby creating a hollow cavity portion. Various known plug assemblies, such as plug chargers for electrical devices having batteries, house circuitry usually mounted on a printed circuit board (PCB) positioned within a body portion. Typically, flexible wires are used to electrically couple the AC prongs to the circuit on the PCB. A drawback of such plug assemblies is that the cavity of the plug housing is not used to house this circuitry, or to reduce the amount of circuitry mounted on the PCB positioned in the body portion.

For plug assemblies that include a plug housing having a cavity portion, the body portion is bulkier than necessary and space is wasted within the plug housing. As a consequence, the packaging size of such plug assemblies is not optimized and the material cost is higher than necessary.

In addition, known means of providing electrical contact between the AC prongs and the circuit on a PCB to be powered by the AC power source is through the use of flexible wires, extended copper springs, or the direct soldering of the prongs to the PCB. The use of such wires, springs, or direct soldering makes assembly more difficult than necessary. What is needed is a structure that creates a secure electrical and mechanical contact between the AC prongs and the PCB within the plug assembly that can be assembled quickly and easily and which optimizes packaging size and reduces the plug assembly's profile. What is also needed is a structure that allows the PCB electrical contacts to be closer to the AC prongs in order to further optimize packaging size.

SUMMARY OF THE INVENTION

The present invention solves the above identified problems of known devices by providing a plug assembly wherein a PCB is located in the hollow portion of the plug housing and the AC prongs are electrically connected to the PCB using spring loaded contacts mounted on the PCB.

Broadly stated, the present invention is directed to a plug assembly including a body portion and a plug housing connected thereto and having a plurality of AC prongs extending therefrom shaped to enable the plug assembly to be connected to an AC female outlet, the plug housing providing a mounting for the plurality of AC prongs and creating a cavity in the plug housing, the plug assembly comprising a first printed circuit board mounted in the plug housing and extending into the cavity, and a pair of contact terminals mounted on the first printed circuit board, each contact terminal in a predetermined position so as to create a spring-loaded electrical contact with a corresponding one of the AC prongs.

In one embodiment of the present invention, the first PCB is mounted to the body portion of the plug assembly. For a second embodiment, the plug assembly has a second printed circuit board mounted in the body portion operatively connected to the first printed circuit board. For a third embodiment, the first printed circuit board has one portion mounted in the body portion and a second portion mounted in the plug housing. In anther embodiment of the plug assembly of the present invention, a second printed circuit board is mounted in the body portion and extended into the plug housing, wherein the first printed circuit board is operatively connected to the second printed circuit board. In yet another embodiment, a second printed circuit board is mounted in the body portion, wherein the first printed circuit board extends into the body portion and is operatively connected to the second printed circuit board.

The present invention also provides a preferred and two alternate contact terminals, any of which can be used with any of the plug assembly embodiments described herein. The present invention also provides a corresponding method for assembling the plug assembly.

The present invention reduces the bulkiness, optimizes the packaging size, and reduces the profile of the plug assembly by using the hollow area of a plug housing to house a PCB having components mounted thereon, thereby providing a reduction or elimination of the need to mount components within the body portion of the plug assembly. A further advantage of the present invention is that it eliminates the need to use flexible wires, springs, or direct soldering between the AC prongs and the circuitry on the PCB, thereby making assembly of the plug assembly quicker and easier through use of a spring loaded contact terminal. A further advantage of the present invention is that it reduces the overall material cost of the plug assembly as a result of the optimized packaging size.

BRIEF DESCRIPTION OF THE DRAWINGS

The forgoing aspects and the attendant advantages of the present invention will become more readily appreciated by reference to the following detailed description, when taken in conjunction with the accompanying drawings, wherein.

DETAILED DESCRIPTION OF THE INVENTION

Figure 1:
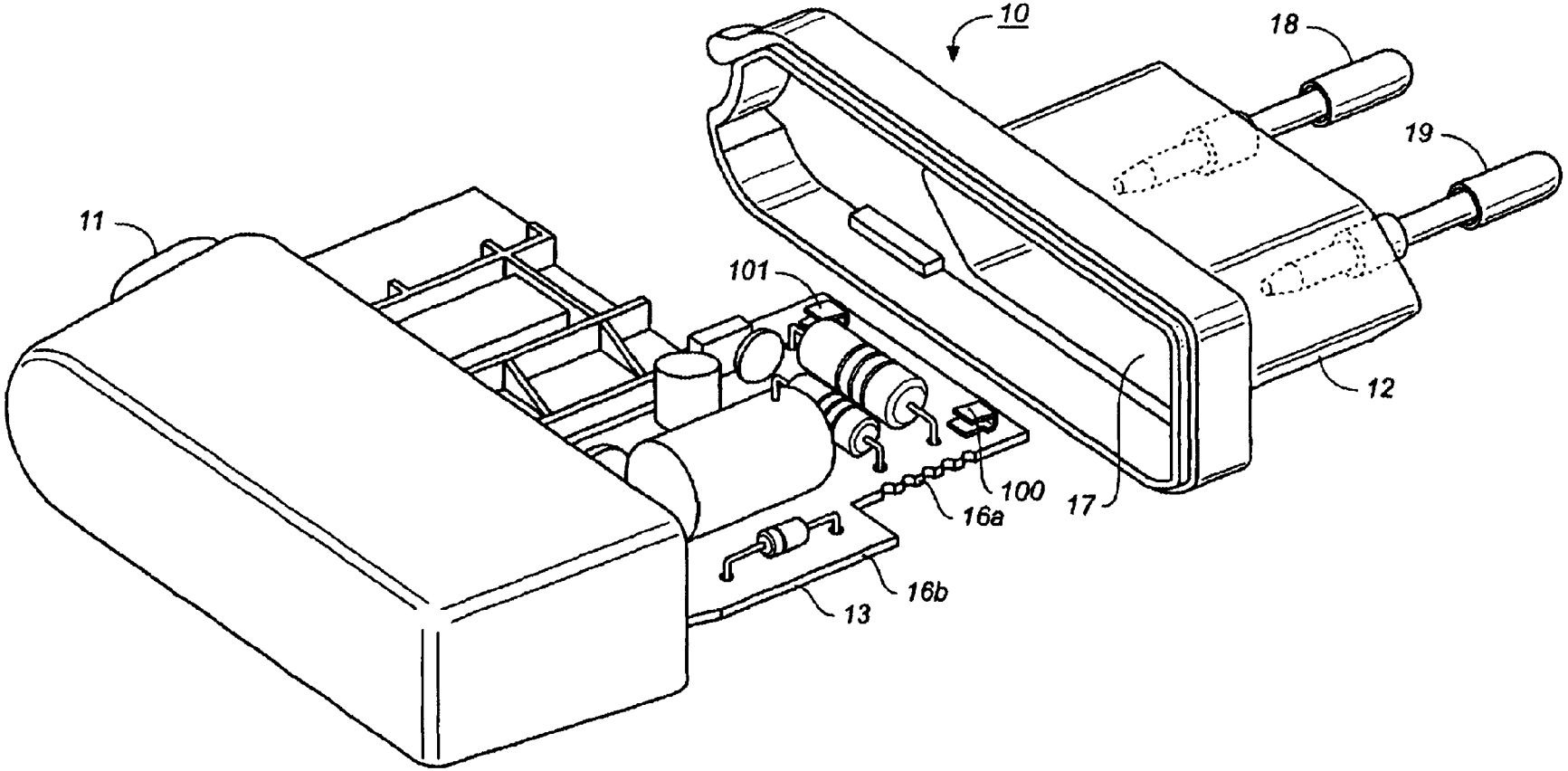
FIG. 1 is an exploded view of a preferred embodiment of the plug assembly of the present invention showing the plug housing in phantom for clarity.
Figure 4A:
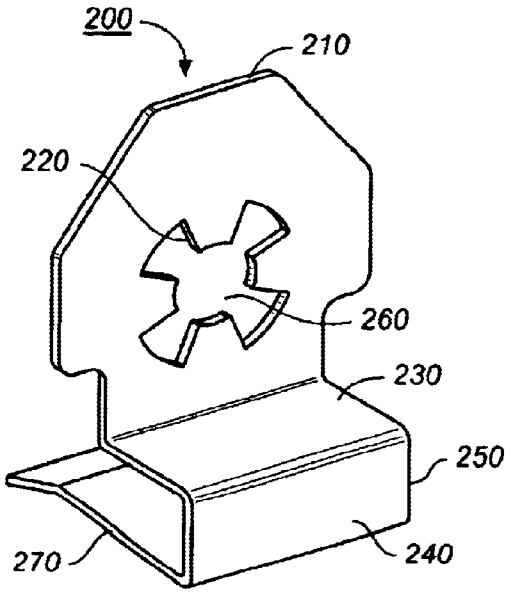
FIG. 4A is a front perspective view of the contact terminal of the plug assembly embodiment of FIG. 3.
Figure 4B:
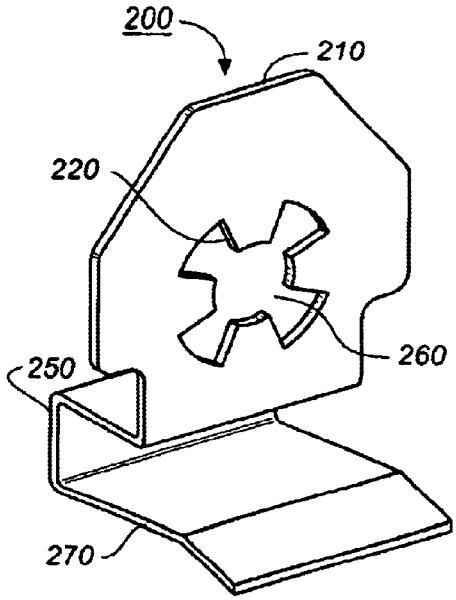
FIG. 4B is a rear perspective view of the contact terminal of the plug assembly embodiment of FIG. 3.
Figure 4C:
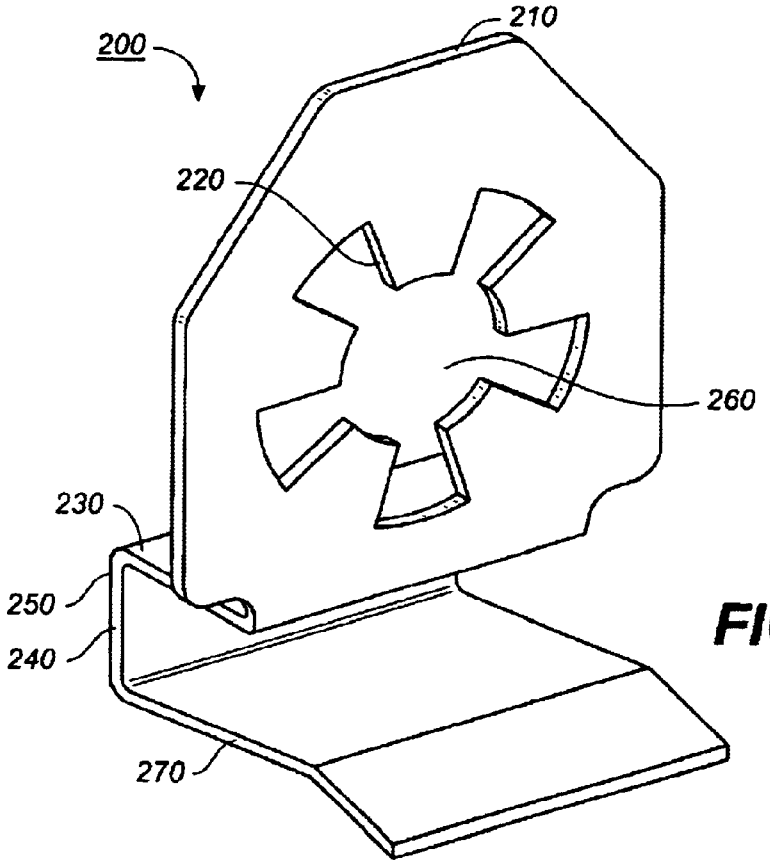
FIG. 4C is an enlarged rear perspective view of the contact terminal of the plug assembly embodiment of FIG. 3.
Figure 5:
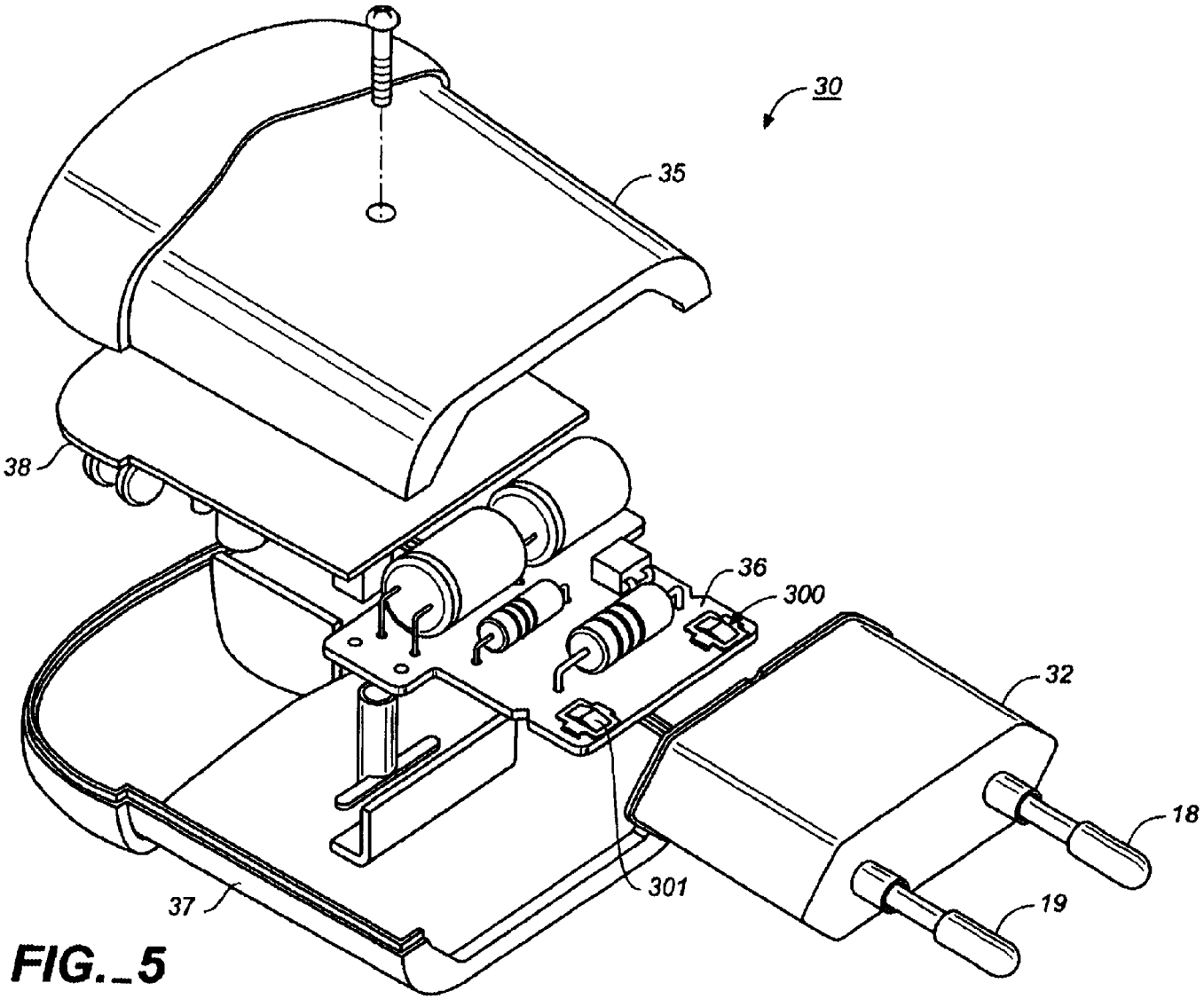
FIG. 5 is an exploded view of another alternate embodiment of the plug assembly of the present invention.
Figure 6:
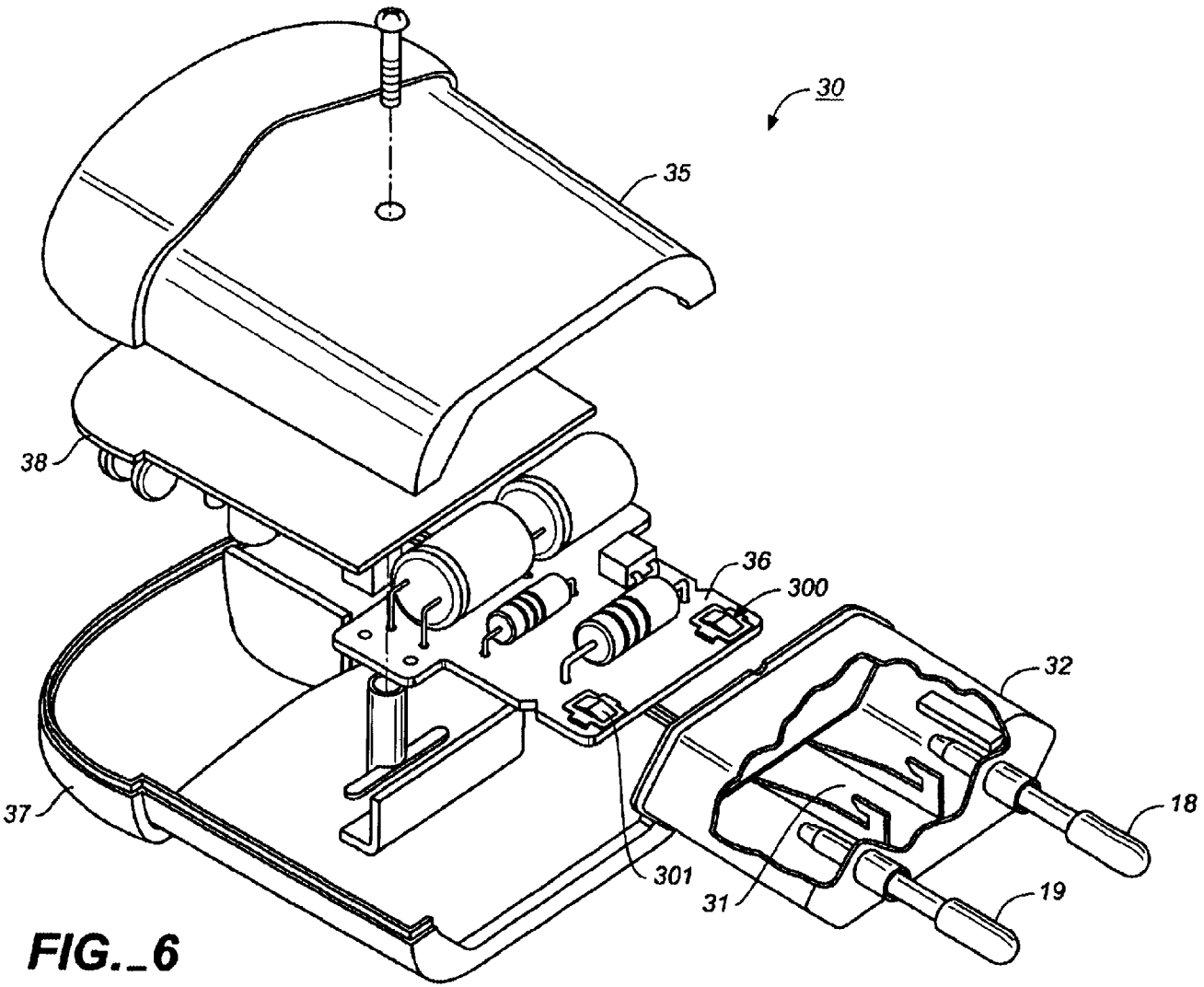
FIG. 6 is an exploded view of the embodiment of the plug assembly of FIG. 5, showing the plug housing and the body portion in phantom for clarity.
Figure 7:
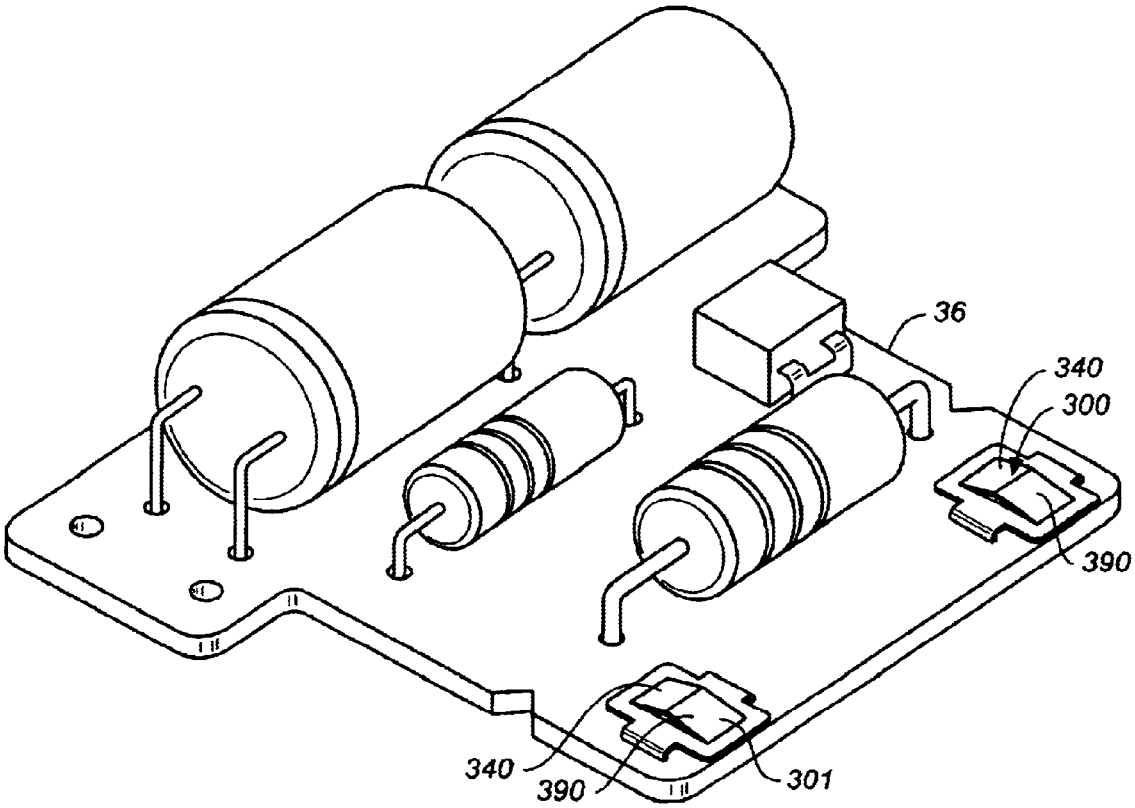
FIG. 7 is an enlarged elevational view of an exemplary PCB of the plug assembly of FIG. 5, showing contact terminals according to the present invention.
Figure 8:
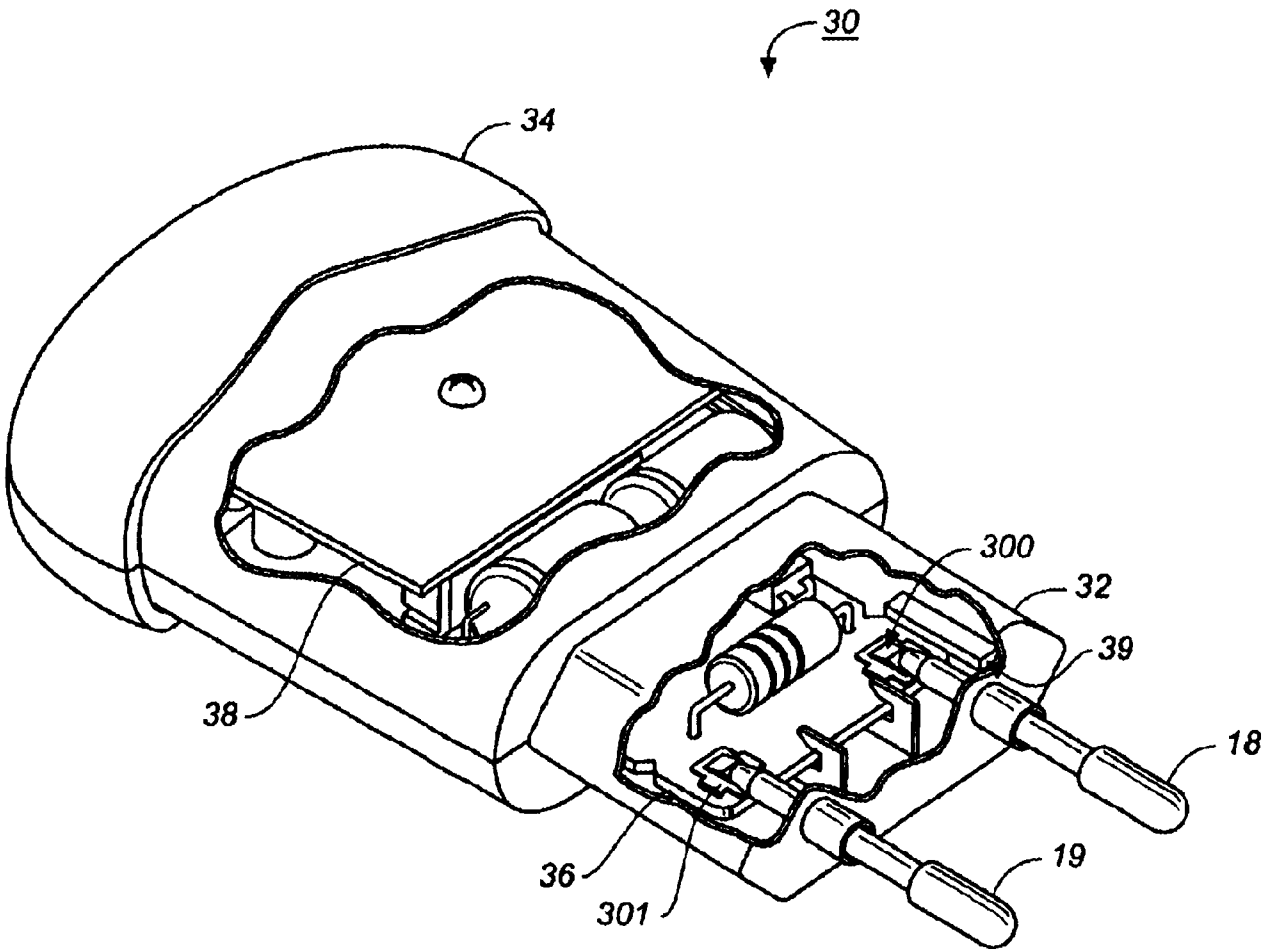
FIG. 8 is a perspective view of the embodiment of the plug assembly of FIG. 5, showing the plug housing and the body portion connected in the operative position and in phantom for clarity.

The present invention will now be described in more detail with reference to FIGS. 1–10. FIG. 1 is an exploded view of an embodiment of the plug assembly of the present invention. Plug assembly 10 has a body portion 11 having a first printed circuit board 16 mounted therein and a plug housing 12 (shown in phantom in FIG. 1 for clarity). In an alternate embodiment of the present invention, e.g., as shown in FIG. 5, plug assembly 30 also includes a second printed circuit board 38 operatively connected to the first printed circuit board 36. In the preferred embodiment, printed circuit board 13 in FIG. 1 comprises one portion 16*b* mounted to the body portion 11 and a second portion 16*a* mounted in the plug housing 12. In the embodiment of FIG. 5, as described below, the second printed circuit board 38 is mounted in the body portion 11 and operatively connected to a first printed circuit board 36 mounted in the plug housing 12. In the embodiment of FIG. 8, as described below, the second printed circuit board 38 extends from the body portion into the plug housing 12 and is operatively connected to the first printed circuit board 36 mounted in the plug housing.

In FIG. 1, the plug housing 12 and body portion 11 are shaped to enable secure mechanical contact therebetween. Plug housing 12 has a pair of AC prongs 18, 19 mounted therein and extending therefrom. AC prongs 18, 19 are shaped to enable electrical and mechanical connection to an outlet or receptacle of a commercial AC power source (not shown). As seen in FIG. 1, a portion of each prong 18, 19 extends into plug housing 12. In the exemplary embodiment of FIG. 1, plug housing 12 conforms to the applicable European plug standards CEE 7/16 and EN50075. In another embodiment shown in FIGS. 11 and 12, U.S. type prongs are shown in a plug housing conforming to the applicable plug standards UL 498 and UL 1310. The present invention, however, is not limited to the use of a European or U.S. plug. Any suitably shaped prongs and plug housing may be used.

In FIG. 1, plug housing 12 provides a mounting for the AC prongs 18, 19 and creates a hollow "cavity" portion 17 within the plug housing 12. A pair of contact terminals 100, 101 are mounted to the printed circuit board 13 at a predetermined position so as to create a spring-loaded electrical contact with a corresponding one of the AC prongs 18, 19. For the preferred embodiment of the plug assembly of FIG. 1, one PCB portion 16*b* is mounted to the body portion 11 and AC prongs 18, 19 are mounted to the plug housing 12 to enable the contact terminals 100, 101 on the other PCB portion 16a to have spring-loaded contact with the AC prongs 18, 19; such that the other PCB portion 16*a* is within the cavity portion 17 when the body portion 11 and plug housing 12 are joined together during assembly.

The present invention overcomes the drawbacks of the known plug assemblies by utilizing the hollow cavity portion 17 to accommodate the first circuit board 16. Cavity portion 17 provides space to house circuitry that would otherwise be located in the body portion 11 or to reduce the amount of circuitry in the body portion 11, thereby reducing the size and bulkiness of the plug assembly 10. The contact terminals 100, 101 of the present invention provide a spring-loaded contact with a corresponding one of the AC prongs 18, 19 which further reduces the size of the plug assembly by providing a contact with the PCB that is closer to the AC prongs 18, 19. The plug assembly of the present invention also makes assembly simpler and easier by providing for slidable assemby and eliminating the need for wires to connect to the AC prongs 18, 19. The pair of contact terminals 100, 101 and the spring-loaded contact are described in more detail in FIGS. 2A –2C.

Figure 2A:
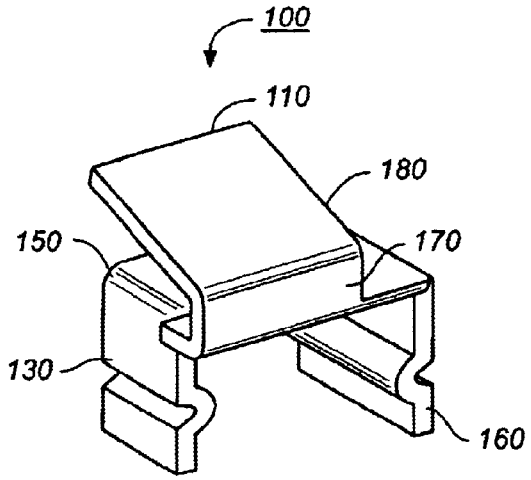
FIG. 2A is a front perspective view of the contact terminal of the plug assembly embodiment of FIG. 1.
Figure 2B:
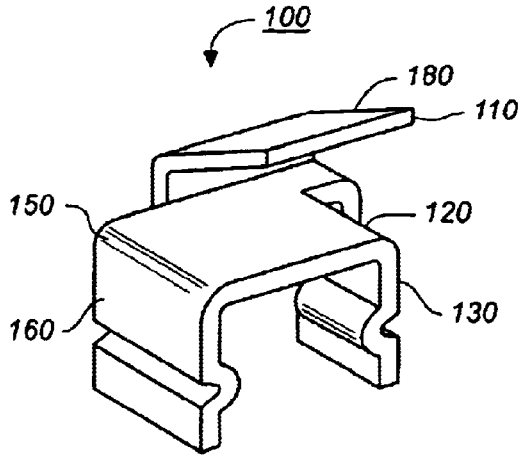
FIG. 2B is a rear perspective view of the contact terminal of the plug assembly embodiment of FIG. 1.
Figure 2C:
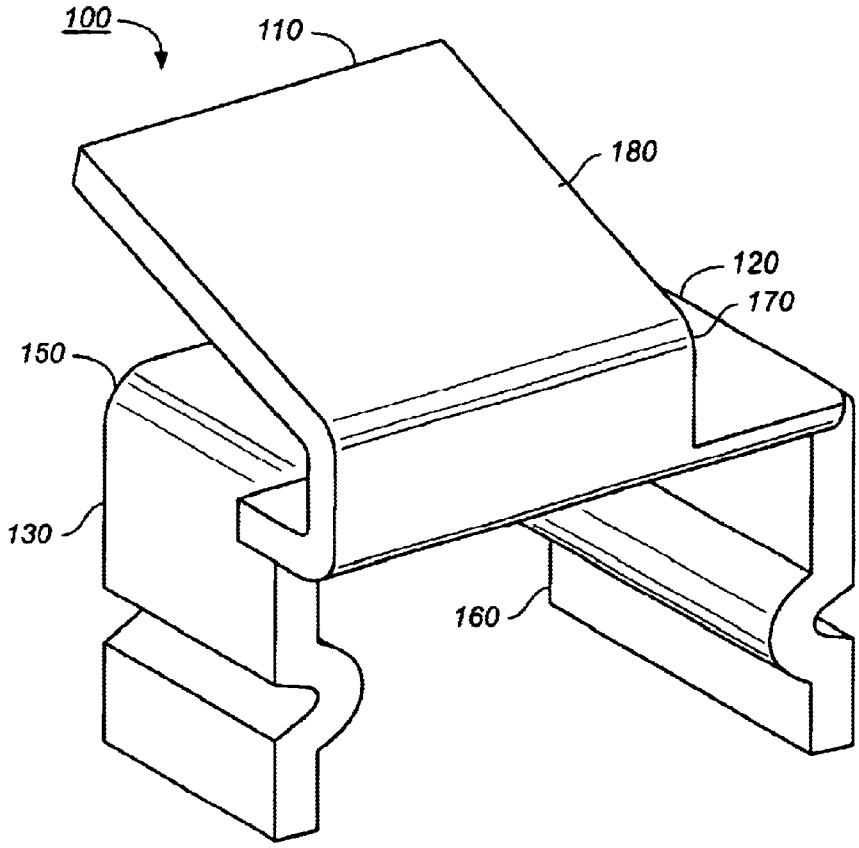
FIG. 2C is an enlarged front perspective view of the contact terminal of the plug assembly embodiment of FIG. 1.

FIGS. 2A and 2C show front perspective views of one of the contact terminals 100, 101 of the preferred embodiment of the plug assembly in FIG. 1, the contact terminals 100, 101 being identical. FIG. 2B is a rear perspective view of one of the contact terminals 100, 101. Contact terminals 100, 101 includes a first portion 150 and a contact spring member 110. Contact terminals 100, 101 are made of a conductive material, preferably copper. First portion 150 has a pair of support legs 130, 160 and a lateral portion 120. The lateral portion 120 extends laterally between the pair of support legs 130, 160. Lateral portion 120 couples spring member 110 to the support legs 130, 160. Contact spring member 110 includes a vertical portion 170 and a blade portion 180, both being flexible portions. Vertical portion 170 is disposed on the lateral portion 120 and extends vertically therefrom. Blade portion 180 is coupled to the vertical portion 170 and extends therefrom at a predetermined angle.

In FIG. 1, each of the contact terminals 100, 101 is mounted to the first circuit board 16. Means for securely electrically and mechanically connecting the contact terminals 100, 101 to the first circuit board 16 are provided; such means being known to one of ordinary skill in the art. In the operative position, with the support legs 130, 160 and lateral of first portion 120 of first portion 150 secured to the first circuit board 16, the blade portion 180 of contact spring member 110 flexibly contacts the corresponding one of the AC prongs 18, 19. The blade portion 180 and vertical portion 170 flexible couple the corresponding one of the AC prongs 18, 19 to the first portion 150 mounted on first circuit board 16, providing a secure spring-loaded mechanical and electrical contact between the corresponding on of AC prongs 18, 19 and the contact terminal 100, 101. As a result, the pair of contact terminal 100, 101 securely electrically connects the corresponding one of AC prongs 18, 19 to the first circuit board 16 in the plug housing 12.

Figure 3:
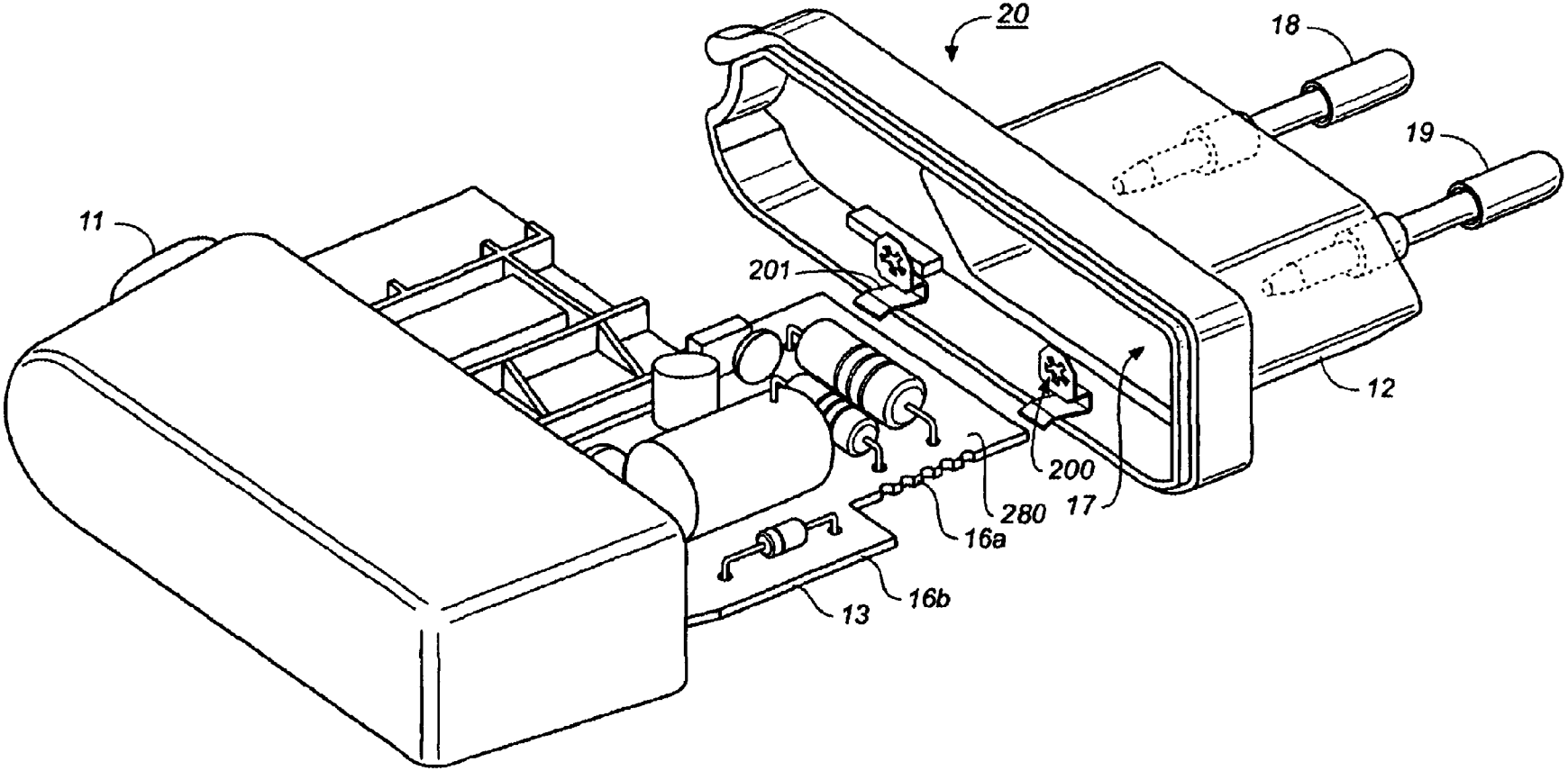
FIG. 3 is an exploded view of a first alternate embodiment of the plug assembly of the present invention showing the plug housing in phantom for clarity.

An exemplary embodiment of the plug assembly of the present invention will now be described in more detail with reference to FIGS. 3–4C. FIG. 3 is an exploded view of a first alternate exemplary embodiment of the plug assembly 20 of the present invention showing the plug housing in phantom for clarity. The embodiment of FIG. 3 includes alternate contact terminals 200, 201 to provide a snap fitting to a corresponding one of the AC prongs 18, 19. FIG. 4A is a front perspective view of one of the contact terminals 200, 201 of FIG. 3. FIGS. 4B and 4C are rear perspective views of one of the contact terminals 200, 201 of FIG. 3. Contact terminals 200, 201 are identical and made of a conductive material, preferably copper. For plug assembly embodiment 20, contact terminals 200, 201 are mounted to the first printed circuit board 16 and provide electrical contact thereto.

As shown in FIGS. 4A–4C, each one of the contact terminals 200, 201 includes contact spring member 210 coupled to a first portion 250 and extending therefrom. Contact spring member 210 has a plurality of contact members 220 forming an opening 260. Preferably, contact members 220 are flexible tabs. First portion 250 includes a first base member 230, a second base member 270, and a lateral member 240. First base member 230 is coupled to contact spring member 210 and spaced apart from second base member 270. Lateral member 240 extends between first base member 230 and second base member 270.

During assembly of the plug assembly 20, a corresponding one of the prongs 18, 19 is extended into the opening 260 and flexibly engages contact members 220 of contact spring member 210 that is oriented in a direction as shown in the exploded view of FIG. 3. Operatively connected, contact members 220 provide a flexible spring action to provide secure mechanical snap fitted contact to a corresponding one of the AC prongs 18, 19.

First printed circuit board 16 has a first surface 280 and an opposite second surface (not shown in FIG. 3, but facing into the page). Lateral member 240 separates the first base member 230 and second base member 270 by a distance such that first base member 230 flexibly connects to a first surface 280 and second base member 270 flexibly connects to the second surface. In this way, contact terminals 200, 201 are clipped to the first printed circuit board 16 to provide secure electrical and mechanical connection therewith. Means are provided on the first printed circuit board 16 to provide the electrical and mechanical connection to each of the contact terminals 200, 201, such means are well known to one of ordinary skill in the art.

FIG. 5 is an exploded view of another alternate embodiment of the plug assembly of the present invention. FIG. 6 is an exploded view of the embodiment of the plug assembly of FIG. 5, showing the plug housing and the body portion in phantom for clarity. Plug assembly 30 has a body portion 34 (shown in the operative position in FIG. 8) comprised of case portions 35 and 37, and a plug housing 32 (shown in phantom in FIG. 6 and FIG. 8). Body portion 34 has a second printed circuit board 38 mounted therein. The second printed circuit board 38 is operatively connected to a first printed circuit board 36. Contact terminals 300, 301 are mounted on first printed circuit board 36. FIG. 7 is an enlarged elevational view of an exemplary first printed circuit board 36 of the plug assembly of FIG. 5, showing contact terminals 300, 301.

FIG. 8 is a perspective view of the embodiment of the plug assembly of FIG. 5, showing the plug housing and the body portion connected in the operative position and in phantom for clarity. The two prongs 18, 19 extend outwardly from the plug housing 32 to provide connection to an outlet or receptacle of an AC power source (not shown). A portion of prongs 18, 19 extends into plug housing 32. Plug housing 32 has a cavity portion 31 (seen best in FIG. 6) therein. As shown in the operative position in FIG. 8, first printed circuit board 36 is within the cavity portion 31 and extends into body portion 11 and is operatively connected to the second circuit board 38.

Figure 9:
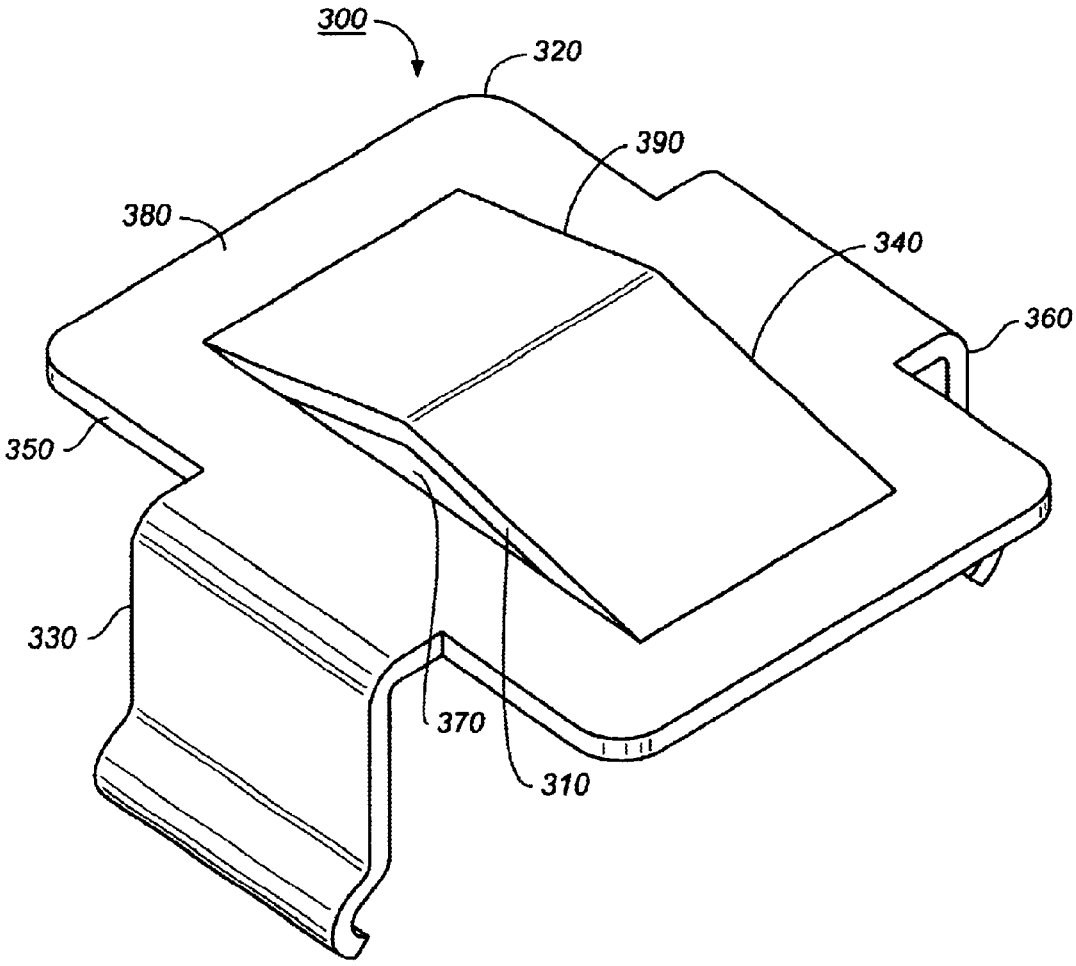
FIG. 9 is an isometric view of the contact terminal of the plug assembly of FIG. 5.

FIG. 9 is an isometric view of the alternate contact terminals 300, 301 of the plug assembly of FIG. 5. Contact terminals 300, 301 include a first portion 350 and a contact spring member 310. Contact terminals 300, 301 are made of a conductive material, preferably copper. The first portion 350 has a pair of legs 330, 360 and a lateral portion 320 that extends between the legs 330, 360 and couples spring member 310 thereto. Lateral portion 320 has a first surface 380 and an opposite second surface (not shown in FIG. 9, but facing into the page), and an opening 370. The opening 370 extends through the first surface 380 and the opposite second surface.

Contact spring member 310 includes a first raised portion 390 and a second raised portion 340 that are coupled to lateral portion 320 and extend therefrom. As seen best in the exemplary embodiment of FIG. 9, the first raised portion 390 extends from one end of lateral portion 320 proximate to the opening 370. Second raised portion 340 extends from an opposite end of lateral portion 320. First raised portion 390 extends from first portion 350 at a first angle with respect to lateral portion 320. Second raised portion 340 extends at a second angle from first portion 350 with respect to lateral portion 320. First raised portion 390 and second raised portion 340 are flexibly coupled at a junction point. The orientation of the first raised portion 390 and a second raised portion 340 for use in the plug assembly 30 are best seen in FIG. 7.

For an exemplary assembly, a corresponding one of the AC prongs 18, 19 initially slidably engages the first raised portion 390 which flexibly contacts the corresponding prong. As seen best in FIG. 8, each of the prongs 18, 19 has a conical tip which is flexibly and securely contacted by the corresponding contact terminal 300, 301 through a spring action provided by the flexible contact spring member 310 of contact terminal 300, 301. Contact terminal 300, 301 provides a spring loaded contact to provide a secure electrical connection between a the AC prongs 18, 19 and the first printed circuit board 36 that the contact terminals 300, 301 are mounted thereto.

Figure 11:
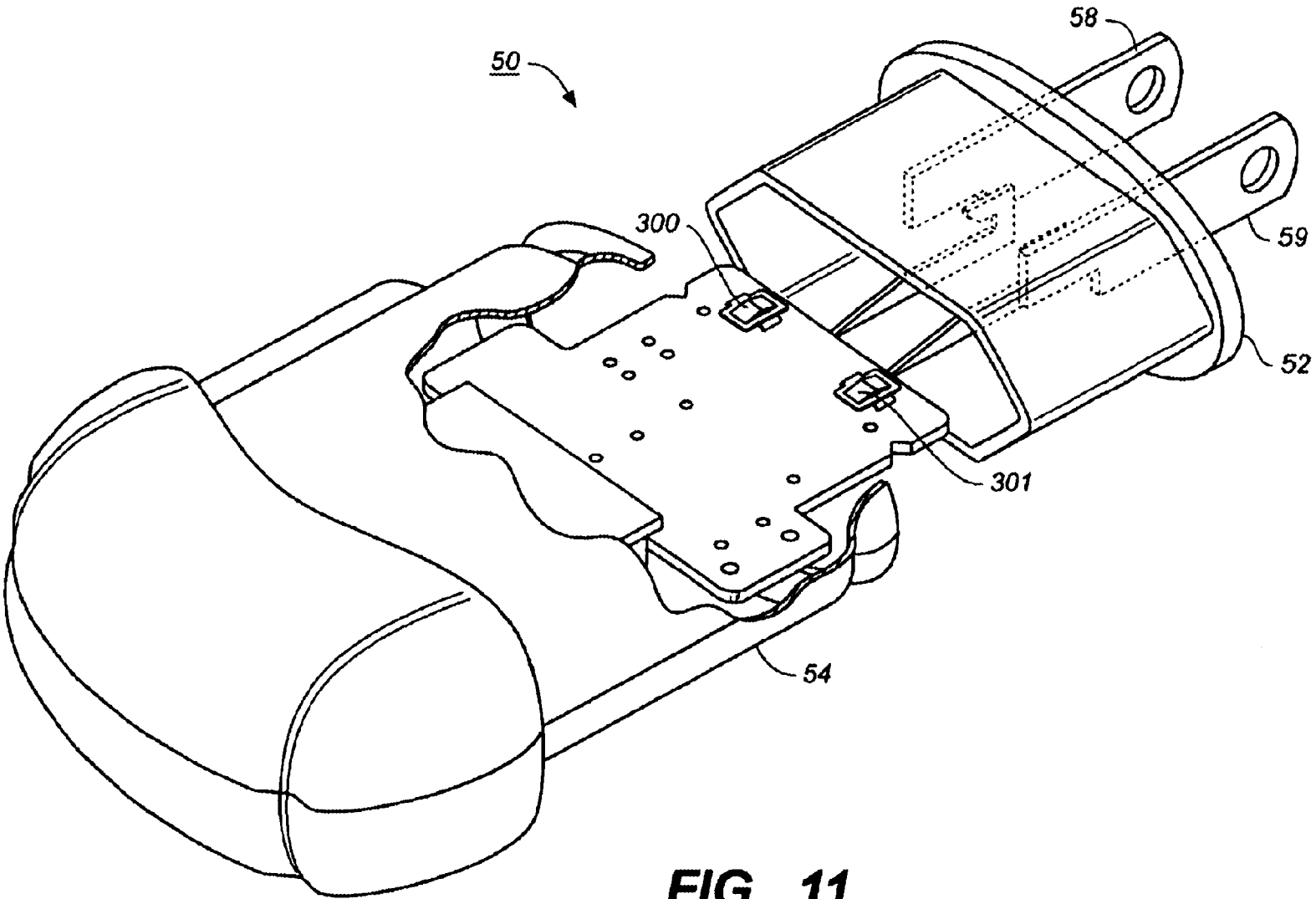
FIG. 11 is an exploded view of an embodiment of the plug assembly having AC prongs conforming to a U.S. plug standards where the plug housing and body portion are both shown in phantom for clarity.
Figure 12:
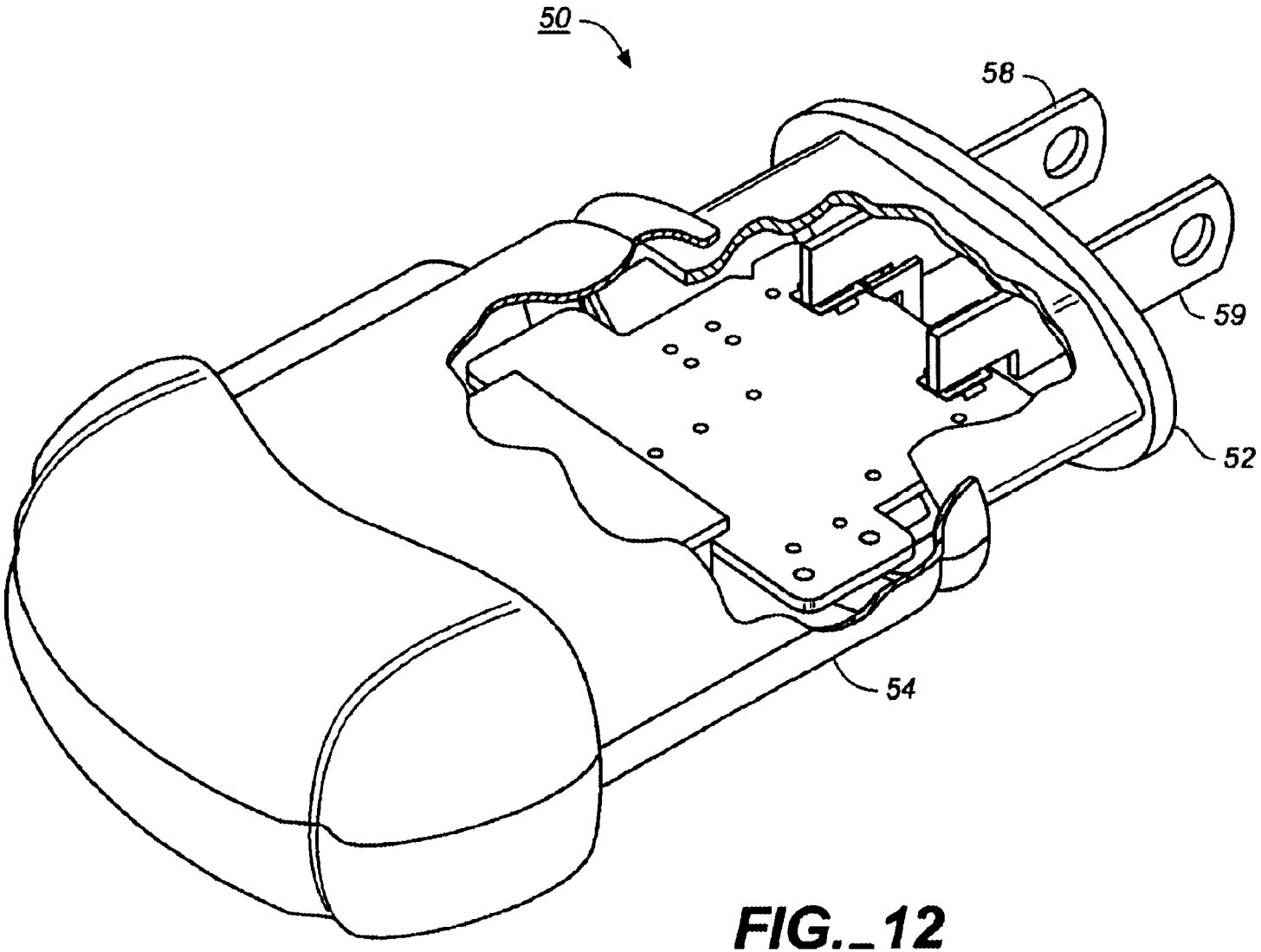
FIG. 12 is a perspective view of the embodiment of the plug assembly of FIG. 11, showing the plug housing and the body portion connected in the operative position and in phantom for clarity.

In another embodiment, the plug assembly has U.S. type AC prongs in a plug housing conforming to the applicable plug standards UL 498 and UL 1310. FIG. 11 is an exploded view of an embodiment of a plug assembly 50 having U.S. type AC prongs 58, 59 in a plug housing 52. FIG. 12 is a perspective view of the embodiment of the plug 15 assembly of FIG. 11, showing the plug housing 52 and the body portion 54 connected in the operative position. The plug housing 52 and body portion 54 in FIGS. 11 and 12 are shown in phantom for clarity.

Figure 10:
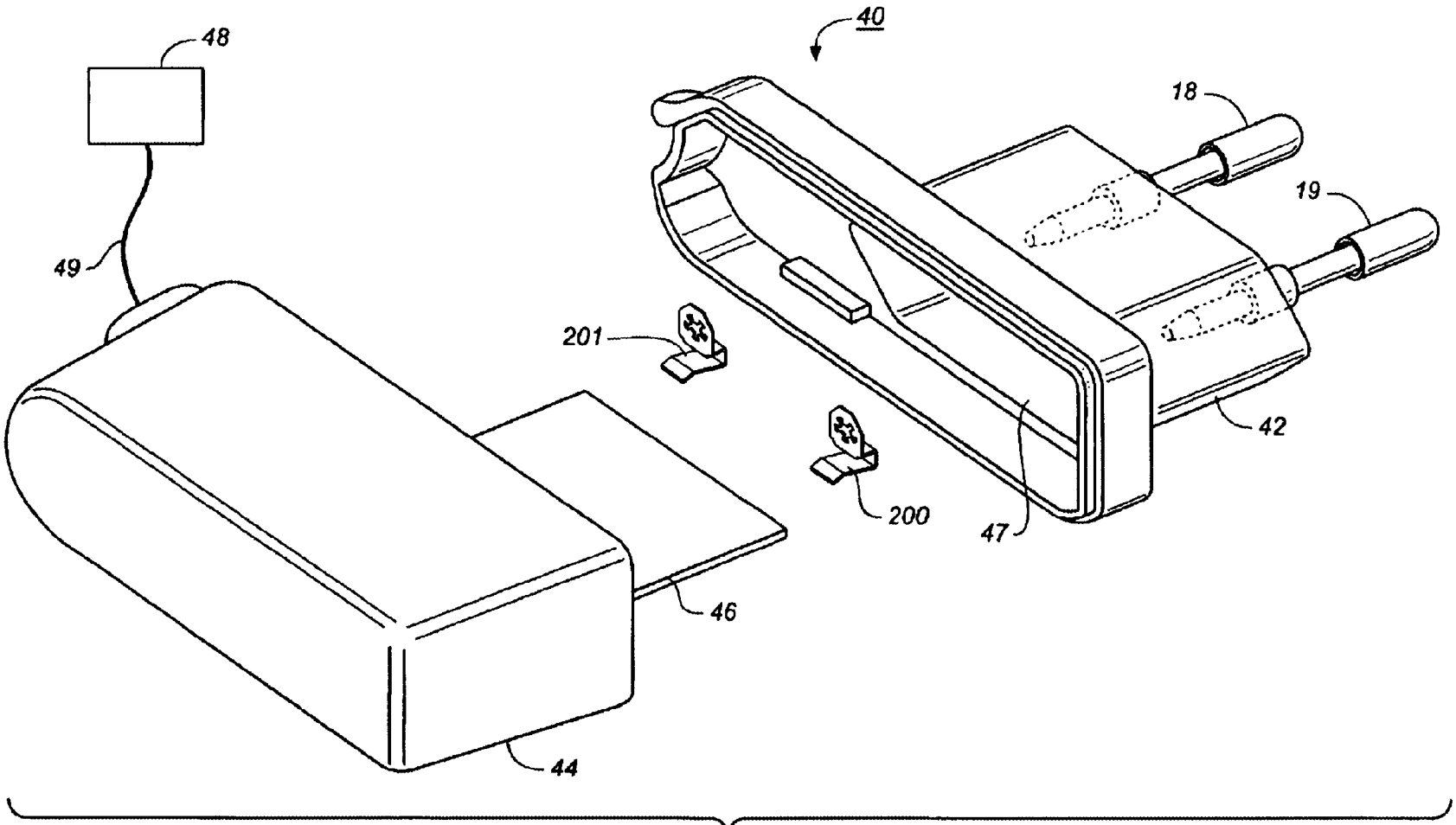
FIG. 10 is an exploded view of an embodiment of the plug assembly of the present invention showing the plug housing, printed circuit board, and exemplary battery all in phantom.

An exemplary plug assembly of the present invention further includes an output connector and a means to connect the output connector to a battery. FIG. 10 is an exploded view of an exemplary embodiment of the plug assembly 40 of the present invention showing the plug housing 42, a printed circuit board, and a battery 48 all in phantom. For this alternate embodiment, plug assembly 40 has a single printed circuit board 46 having circuitry thereon (not shown) that extends from the body portion 44 into the plug housing 42. In the example shown in FIG. 10, plug assembly 40 serves as a plug charger providing power to a rechargable battery 48 connected to the plug assembly 40 by means of an exemplary cable 49 coupled between the body portion 44 and a rechargable battery 48 (details not shown). Preferably the battery 48 is coupled to an electrical device (not shown). The present invention is not limited to this exemplary application, any suitable device may be connected by suitable means to the plug assembly of the present invention. The plug assembly of the present invention, for example, can also serve as a plug adaptor to provide the conversion of AC power into the required DC voltages for powering an electrical device that is powered only from an AC source.

The foregoing detailed description of the invention has been provided for the purposes of illustration and description. Although exemplary embodiments of the present invention have been described in detail herein with reference to the accompanying drawings, it is to be understood that the invention is not limited to the precise embodiments disclosed, and that various changes and modifications to the present invention are possible in light of the above teaching.

What is claimed is:

1. A plug assembly including a body portion and a plug housing connected thereto and having a plurality of AC prongs extending therefrom shaped to enable said plug assembly to be connected to an AC female outlet, said plug housing providing a mounting for said plurality of AC prongs and creating a cavity, said plug assembly comprising:

a first printed circuit board mounted in said plug housing and extending into said cavity, and a pair of contact terminals mounted on said first printed circuit board, each contact terminal in a predetermined position so as to create a spring-loaded electrical contact with a corresponding one of said AC prongs; and a second printed circuit board mounted in said body portion and extended into said plug housing, wherein said first printed circuit board is operatively connected to said second printed circuit board.

2. A plug assembly including a body portion and a plug housing connected thereto and having a plurality of AC prongs extending therefrom shaped to enable said plug assembly to be connected to an AC female outlet, said plug housing providing a mounting for said plurality of AC prongs and creating a cavity, said plug assembly comprising:

a first printed circuit board mounted in said plug housing and extending into said cavity, and a pair of contact terminals mounted on said first printed circuit board, each contact terminal in a predetermined position so as to create a spring-loaded electrical contact with a corresponding one of said AC prongs; and a second printed circuit board mounted in said body portion, wherein said first printed circuit board extends into said body portion and is operatively connected to said second printed circuit board.

3. A plug assembly including a body portion and a plug housing connected thereto and having a plurality of AC prongs extending therefrom shaped to enable said plug assembly to be connected to an AC female outlet, said plug housing providing a mounting for said plurality of AC prongs and creating a cavity, said plug assembly comprising:

a first printed circuit board mounted in said plug housing and extending into said cavity, and a pair of contact terminals mounted on said first printed circuit board, each contact terminal in a predetermined position so as to create a spring-loaded electrical contact with a corresponding one of said AC prongs, each of said contact terminals comprising:

a first portion for providing mechanical support for said contact terminal and electrical contact to said first printed circuit board when said contact terminal is mounted thereon;

a contact spring member coupled to said first portion and extending therefrom, said spring member flexibly contacting one of said corresponding AC prongs so as to provide secure electrical contact between said AC prong and said first portion, said contact spring member comprising:

a vertical portion oriented substantially perpendicular to said first printed circuit board, and a blade portion flexibly coupled to said vertical portion and extending therefrom at a predetermined angle, such that said blade portion flexibly contacts a corresponding one of said prongs to provide secure electrical contact between said prongs and said first portion;

wherein said first portion of each said contact terminal comprises:

a pair of support legs mounted to said first printed circuit board; and a lateral portion coupling said spring member to said support legs, said lateral portion extended laterally between said support legs.

4. A plug assembly including a body portion and a plug housing connected thereto and having a plurality of AC prongs extending therefrom shaped to enable said plug assembly to be connected to an AC female outlet, said plug housing providing a mounting for said plurality of AC prongs and creating a cavity, said plug assembly comprising:

a first printed circuit board mounted in said plug housing and extending into said cavity, and a pair of contact terminals mounted on said first printed circuit board, each contact terminal in a predetermined position so as to create a spring-loaded electrical contact with a corresponding one of said AC prongs, each of said contact terminals comprising:

a first portion for providing mechanical support for said contact terminal and electrical contact to said first printed circuit board when said contact terminal is mounted thereon;

a contact spring member coupled to said first portion and extending therefrom, said spring member flexibly contacting one of said corresponding AC prongs so as to provide secure electrical contact between said AC prong and said first portion, said contact spring member comprising a plurality of contact members forming an opening for receiving one of said corresponding AC prongs such that one of said corresponding AC prongs is snap fitted to said contact spring member; and wherein said first portion comprises:

a first base member and a second base member spaced apart from each other, said first base member coupled to said contact spring member and to a first surface of said first printed circuit board, said second base member coupled to a second surface of said first printed circuit board; and a lateral member extending between said first and second base members; said lateral member separating said base members by a distance such that said first base member flexibly connects to a first surface of said first printed circuit board and said second base member flexibly connects to a second surface of said first printed circuit board such that said base members provide secure electrical and mechanical contact therewith.

5. A plug assembly including a body portion and a plug housing connected thereto and having a plurality of AC prongs extending therefrom shaped to enable said plug assembly to be connected to an AC female outlet, said plug housing providing a mounting for said plurality of AC prongs and creating a cavity, said plug assembly comprising:

a first printed circuit board mounted in said plug housing and extending into said cavity, and a pair of contact terminals mounted on said first printed circuit board, each contact terminal in a predetermined position so as to create a spring-loaded electrical contact with a corresponding one of said AC prongs, each of said contact terminal comprising:

a first portion for providing mechanical support for said contact terminal and electrical contact to said first printed circuit board when said contact terminal is mounted thereon, a contact spring member coupled to said first portion and extending therefrom, said spring member flexibly contacting one of said corresponding AC prongs so as to provide secure electrical contact between said AC prong and said first portion, said contact spring member comprising:

a first raised portion and a second raised portion coupled to said first portion and extending therefrom, said first raised portion extended at a first predetermined angle from said first portion, said second raised portion extended at a second predetermined angle from said first portion such that said first raised portion and second raised portion are coupled; and wherein said first portion of each said contact terminal comprises:

a pair of support legs mounted to said first printed circuit board; and a lateral portion coupling said spring member to said support legs, said lateral portion extended laterally between said pair of support legs, said lateral portion comprising a first surface, a second surface, and an opening extending through said first and said second surfaces.

6. A plug assembly including a body portion and a non-conductive plug housing connected thereto and having a plurality of AC prongs extending therefrom shaped to enable said plug assembly to be connected to an AC female outlet, said plug housing providing a mounting for said plurality of AC prongs and creating a cavity in said plug housing, said plug assembly comprising:

a first printed circuit board mounted in said cavity of said plug housing; electrically connected to said body portion and a pair of contact terminals mounted on said first printed circuit board, each contact terminal in a predetermined position so as to create a spring-loaded electrical contact with a corresponding one of said AC prongs, each said contact terminal comprising:

a first portion for providing mechanical support for said contact terminal and electrical contact to said first printed circuit board when said contact terminal is mounted thereon, said first portion comprising:

a pair of support legs mounted to said first printed circuit board; and a lateral portion extending laterally between said pair of support legs;

a contact spring member comprising:

a vertical portion disposed on said lateral portion and oriented substantially perpendicular to said lateral portion, and a blade portion flexibly coupled to said vertical portion and extending therefrom at a predetermined angle, such that said blade portion flexibly contacts a corresponding one of said prongs to provide secure electrical contact between said prongs and said first portion.

7. A plug assembly including a body portion and a non-conductive plug housing connected thereto and having a plurality of AC prongs extending therefrom shaped to enable said plug assembly to be connected to an AC female outlet, said plug housing providing a mounting for said plurality of AC prongs and creating a cavity in said plug housing, said plug assembly comprising:

a first printed circuit board mounted in said cavity of said plug housing; electrically connected to said body portion and a pair of contact terminals mounted on said first printed circuit board, each contact terminal in a predetermined position so as to create a spring-loaded electrical contact with a corresponding one of said AC prongs, each said contact terminal comprising:

a first portion for providing mechanical support for said contact terminal and electrical contact to said first printed circuit board when said contact terminal is mounted thereon; and a contact spring member coupled to said first portion and extending therefrom, said spring member flexibly contacting one of said corresponding AC prongs so as to provide secure electrical contact between said AC prong and said first portion, said contact spring member comprising a plurality of contact members comprising flexible tabs forming an opening for receiving one of said corresponding AC prongs such that one of said corresponding AC prongs is snap fitted to said contact spring member;

wherein said first portion comprises:

a first base member and a second base member spaced apart from each other, said first base member coupled to said contact spring member and to a first surface of said first printed circuit board, said second base member coupled to a second surface of said first printed circuit board; and a lateral member extending between said base members; said lateral member separating said first and second base members by a distance such that said first base member flexibly connects to a first surface of said first printed circuit board and said second base member flexibly connects to a second surface of said first printed circuit board such that said base members provide secure electrical and mechanical contact therewith.

8. A plug assembly including a body portion and a non-conductive plug housing connected thereto and having a plurality of AC prongs extending therefrom shaped to enable said plug assembly to be connected to an AC female outlet, said plug housing providing a mounting for said plurality of AC prongs and creating a cavity in said plug housing, said plug assembly comprising:

a first printed circuit board mounted in said cavity of said plug housing; electrically connected to said body portion and a pair of contact terminals mounted on said first printed circuit board, each contact terminal in a predetermined position so as to create a spring-loaded electrical contact with a corresponding one of said AC prongs, each said contact terminal comprising:

a first portion for providing mechanical support for said contact terminal and electrical contact to said first printed circuit board when said contact terminal is mounted thereon; and a contact spring member coupled to said first portion and extending therefrom, said contact spring member flexibly contacting one of said corresponding AC prongs so as to provide secure electrical contact between said AC prong and said first portion, said contact spring member comprising:

a first raised portion and a second raised portion coupled to said first portion and extending therefrom, said first raised portion extended at a first predetermined angle from said first portion, said second raised portion extended at a second predetermined angle from said first portion such that said first raised portion and second raised portion are coupled;

wherein said first portion of each said contact terminal comprises:

a pair of support legs mounted to said first printed circuit board; and a lateral portion coupling said spring member to said support legs, said lateral portion extended laterally between said pair of support legs, said lateral portion comprising a first surface, a second surface, and an opening extending through said first and said second surfaces.

9. A method for assembling a plug assembly having a body portion, a plug housing that provides a mounting for AC prongs and creates a cavity therewithin, a first printed circuit board having a circuit thereon, and a second printed circuit board mounted in said body portion, comprising the steps of:

a) mounting a pair of spring loaded contact terminals to said first printed circuit board in a predetermined position so as to create a spring-loaded electrical contact with a corresponding one of said AC prongs after assembly;

b) mounting said first printed circuit board in said body portion, said first printed circuit board having a portion extending therefrom, and operatively connecting said first printed circuit board and said second printed circuit board;

c) positioning said body portion in a direction toward said plug housing such that said portion of said first printed circuit board enters said cavity of said plug housing; and d) moving said body portion toward said plug housing such that said portion of said first printed circuit board slides along said means until each one of said spring-loaded contact terminals slidingly engages a corresponding one of said AC prongs, thereby creating a secure electrical connection between each corresponding prong and a circuit on the first printed circuit board.

* * * * *